US007721979B2

(12) United States Patent
Mazzola

(10) Patent No.: US 7,721,979 B2
(45) Date of Patent: May 25, 2010

(54) SHOWER SPRAY DEVICE

(75) Inventor: Giovanni Maria Mazzola, Valduggia (IT)

(73) Assignee: Ergon S.R.L., Valduggia (VC) (IT)

( * ) Notice: Subject to any disclaimer, the term of this patent is extended or adjusted under 35 U.S.C. 154(b) by 827 days.

(21) Appl. No.: 11/215,117

(22) Filed: Aug. 31, 2005

(65) Prior Publication Data

US 2006/0060678 A1 Mar. 23, 2006

(30) Foreign Application Priority Data

Sep. 15, 2004 (IT) ..... MI2004A1756

(51) Int. Cl.
*B05B 1/30* (2006.01)

(52) U.S. Cl. ..... 239/533.14; 239/106; 239/533.13; 239/548; 239/558; 239/600; 239/602; 239/DIG. 4; 239/DIG. 12

(58) Field of Classification Search ..... 239/104, 239/106, 107, 548, 552, 556, 558, 602, DIG. 4, 239/DIG. 12, 533.13, 533.14, 600
See application file for complete search history.

(56) References Cited

U.S. PATENT DOCUMENTS

| | | | | |
|---|---|---|---|---|
| 2,402,741 | A * | 6/1946 | Draviner | 239/533.14 |
| 2,874,001 | A * | 2/1959 | Webb | 239/533.14 |
| 3,383,050 | A * | 5/1968 | Buckley et al. | 239/533.14 |
| 5,228,625 | A * | 7/1993 | Grassberger | 239/558 |
| 5,405,089 | A * | 4/1995 | Heimann et al. | 239/533.14 |
| 6,250,572 | B1 * | 6/2001 | Chen | 239/602 |
| 6,641,057 | B2 * | 11/2003 | Thomas et al. | 239/104 |
| 6,758,422 | B2 * | 7/2004 | Kuo | 239/602 |

FOREIGN PATENT DOCUMENTS

| | | |
|---|---|---|
| DE | 10313823 | 7/2004 |

OTHER PUBLICATIONS

European Search Report for EP 05019158.4, mailed Feb. 9, 2006, 3 pages.

* cited by examiner

*Primary Examiner*—Steven J Ganey
(74) *Attorney, Agent, or Firm*—Nixon & Vanderhye P.C.

(57) ABSTRACT

A shower spray device is described in which the side wall of the water distribution chamber consists of a sealing element.

18 Claims, 3 Drawing Sheets

SHOWER SPRAY DEVICE

The present invention concerns a shower spray device, also known as "shower head", and in particular a shower spray device which is connected to a rigid supply pipe located in a raised position inside a shower.

The shower spray devices of the known type generally comprise a water distribution chamber in fluid communication with at least one inlet and with a plurality of outlet nozzles for the delivery of water. Some embodiments are also provided with intakes to allow the suction of a certain quantity of air into the distribution chamber and allow a certain aeration of the delivered water.

According to the latest trends, spray devices for showers are currently being studied in terms of appearance and the type of jet requested. For example, spray devices having a design with simple clean-cut lines are generally popular, as well as spray devices that produce a "rain" type jet, with or without aeration of the water delivered.

The search for particularly attractive forms, for example with large dimension but particularly fine section can, however, involve construction difficulties in obtaining water distribution with substantially uniform jets delivered by the nozzles. Said construction difficulties inevitably reflect on the production costs of the spray devices.

The object of the present invention is to propose a shower spray device which has a particularly simple construction and which can therefore be produced at limited costs.

Another object of the present invention is to propose a shower spray device which can be constructed with a particularly small section.

These objects are achieved by the present invention thanks to a shower spray device having at least one water distribution chamber in fluid communication with at least one inlet for the water and with a plurality of water outlet nozzles, characterised in that at least the side wall of said distribution chamber consists wholly or partly of a sealing element.

The sealing element consists preferably of an elastic sealing element, for example an O-ring or the like.

The distribution chamber can for example be formed by a lower plate, in which the outlet nozzles are mounted, and at least one upper plate in which the inlet is obtained for the supply of water to the distribution chamber. The plates are superimposed on each other to retain the sealing element between them.

According to a possible embodiment, the plates consist of flat plates having shape and dimensions substantially similar, or with similar shape and dimensions slightly different.

In at least one of the plates a groove is preferably made which houses at least partially the sealing element. On the opposite plate a machined inner surface portion can also be provided if necessary, positioned in correspondence to the resting area of the sealing element.

A spray device according to the present invention can therefore be produced using particularly simple construction elements, such as plates for coupling to each other, and elements that can be easily found on sale, for example elastic rings like O-rings. The machining on the plates to obtain the groove for housing the sealing element and, if required, the surface portion machined for abutment of the sealing element on the opposite plate can also be produced simply and with limited costs.

The invention will now be described, as a non-limiting example, with reference to the attached drawings in which.

Figure 1:
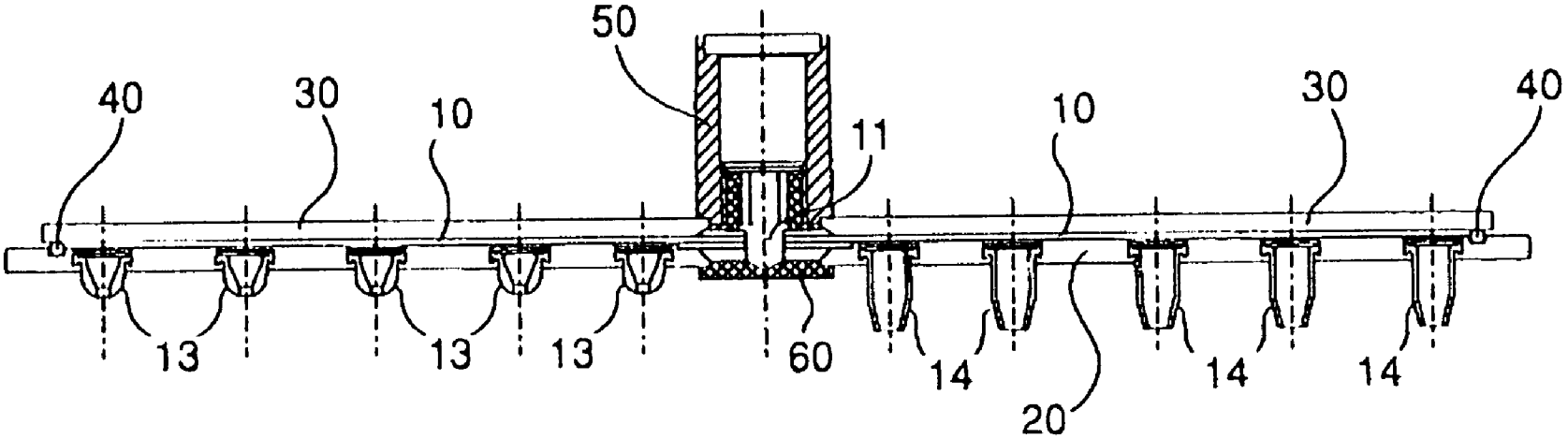
FIG. 1 shows a section view of a possible embodiment of a shower spray device according to the present invention with two different types of nozzles.
Figure 2:
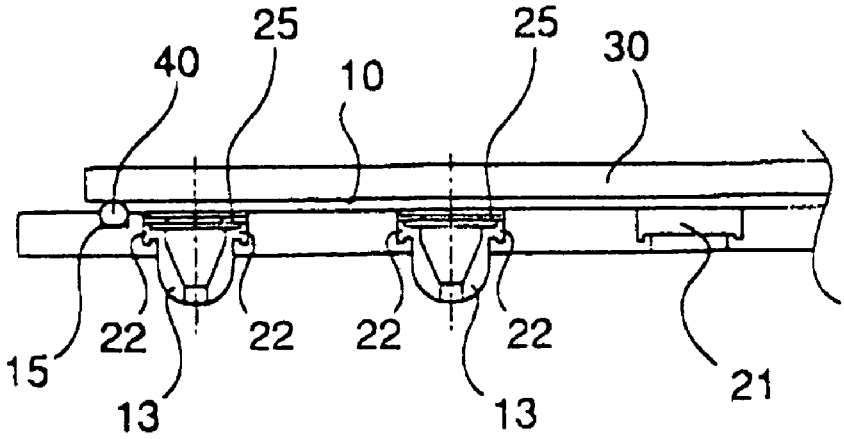
FIG. 2 is an enlarged view of a detail of FIG. 1.

FIGS. 1 and 2 show a shower spray device which comprises, according to the present invention, a distribution chamber 10 for the water in fluid communication with an inlet 11 and with a plurality of outlet nozzles 13 and 14. The latter, generally made of rubber or elastomeric material, are shown according to two possible different types, but it is understood that a device can also comprise only nozzles of the type indicated by 13, or only nozzles of the type indicated by 14, or both with a different distribution with respect to the one shown.

The chamber 10 is defined by a lower plate 20 which houses the outlet nozzles 13 and/or 14 and an upper plate 30 in which the inlet 11 is obtained. The plates 20 and/or 30 can be made for example of metallic materials, for example brass or stainless steel, or in other materials having characteristics suitable for this type of products, for example plastic, ceramic materials or the like.

According to the invention, the distribution chamber 10 is defined by a side wall consisting of a sealing element 40, in particular an elastic sealing element such as a rubber ring like an O-ring. The plates 20 and 30 are therefore mounted superimposed to constitute the lower wall and the upper wall respectively of the chamber 10 and retain between them the sealing element 40 constituting the side wall.

In the embodiment herein illustrated the plates 20 and 30 are flat plates having a similar shape and slightly different dimensions, or both plates can have the same dimensions. The shape in plan view of the plates 20 and 30 can be of any type, for example the traditional circular type or also quadrangular (therefore square or rectangular).

Referring now also to the enlarged view of FIG. 2, it can be noted that the sealing element 40 is housed in a groove 15 obtained in the plate 20 and having a depth such as to leave protruding, in section, a portion of the sealing element sufficient to keep the plates 20 and 30 spaced in order to form the chamber 10 also when the sealing element 40 is compressed between the plates. The groove 15 can for example have a depth slightly lesser or greater than the radius of the section of the sealing element to be housed.

The opposite plate 30 can in turn have a machined surface portion (not shown), for example slightly knurled, herringbone patterned or the like, corresponding to the area where the sealing element 40 rests in order to help the grip of plate 30 on the sealing element. It is obvious, however, that the groove 15 can be alternatively obtained on the plate 30 while the plate 20 can have a machined surface portion if necessary.

As an example, the view of FIG. 2 shows the plate 20 with a seat 21 without a respective nozzle 13 in order to illustrate its shape. Each of the nozzles 13 (or 14) is provided at the end with a perimeter flange 22 shaped so that it can be housed in the seat 21 obtained inside the lower plate 20.

The nozzles 13 (or 14) can be retained in position for example by means of a washer 25, for example a washer made of elastically or plastically deformable material which is press-fitted into the upper part of the seat 21 above the flange 22 of the respective nozzle.

Figure 3A:
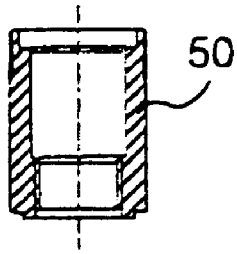
FIGS. 3A and 3B are section views of the connection element and the tightening means for the embodiment illustrated in FIG. 1.
Figure 3B:
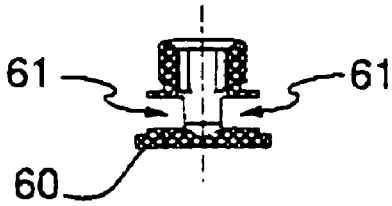

FIGS. 3A and 3B show respectively a connection element 50 and a tightening means 60 which are screw-coupled to retain the plates 20 and 30 of the embodiment of FIG. 1. In this embodiment, openings 61 are provided in the tightening means 60 for fluid communication of the connection 50 with the distribution chamber 10 (FIG. 1).

Figure 4:
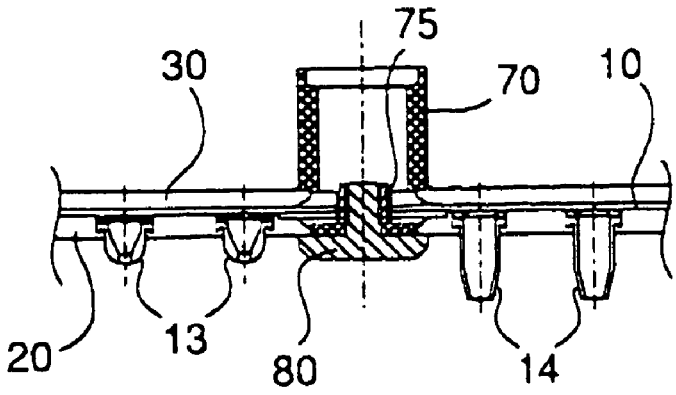
FIG. 4 is a section view that illustrates another possible embodiment for the water supply connection.
Figure 5A:
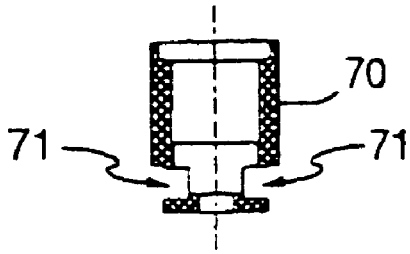
FIGS. 5A and 5B are section views of the connection element and tightening means for the embodiment illustrated in FIG. 4.
Figure 5B:
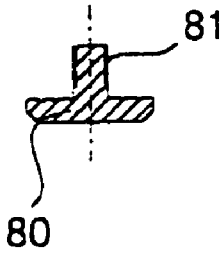

An alternative embodiment, shown in FIGS. 4, 5A and 5B, provides for connection openings 71 obtained in the connection element 70 (FIG. 5A). The tightening means 80 (FIG. 5B) is coupled via its threaded portion 81 to a nut 75 (FIG. 4).

Various modifications can be made without departing from the scope of the present invention. For example, the plates 20 and 30 do not necessarily have to be both flat, or in any case can have similar or different curvatures. If necessary channels hollowed out in one or in both the plates 20 and 30 can also be provided to vary the distribution of the water in the chamber 10 and/or the configuration of the jets delivered by the nozzles 13 or 14.

The invention claimed is:

1. A shower spray device having at least one water distribution chamber in fluid communication with at least one water inlet and with a plurality of water outlet nozzles, said chamber including at least one lower plate housing said outlet nozzles and at least one upper plate in which said inlet is provided, wherein at least the side wall of said distribution chamber consists wholly or partly of a sealing element interposed between said plates, and wherein said sealing element is an elastic sealing element, at least an outer circumferential part of the elastic sealing element remaining exposed external to the distribution chamber even after the lower and upper plates and elastic sealing element have been assembled.

2. A device as claimed in claim 1, wherein said sealing element includes an O-ring.

3. A device as claimed in claim 1, wherein said plates are superimposed to constitute a lower wall and an upper wall respectively of said chamber and retain said sealing element between them.

4. A device as claimed in claim 1, wherein said plates are flat.

5. A device as claimed in claim 1, wherein said plates have substantially similar shapes and dimensions.

6. A device as claimed in claim 1, wherein said plates have similar shapes and slightly different dimensions.

7. A device as claimed in claim 1, wherein at least one of said plates comprises at least one groove for housing said sealing element.

8. A device as claimed in claim 1, wherein at least one of said plates comprises a machined inner surface portion in correspondence to the resting area of said sealing element.

9. A device as claimed in claim 1, wherein said nozzles are made of elastic material.

10. A device as claimed in claim 9, wherein the elastic material includes rubber or like materials.

11. A device as claimed in claim 1, wherein each of said nozzles comprises at one end a perimeter flange designed to be housed in a corresponding seat obtained inside said lower plate.

12. A device as claimed in claim 11, further comprising a fixing device to retain in position each of said nozzles by blocking said perimeter flange in the respective housing seat.

13. A device as claimed in claim 1, wherein at least one connection element is mounted in correspondence to said inlet.

14. A device as claimed in claim 1, further comprising a tightening device to retain said plates in a reciprocally superimposed position.

15. A device as claimed in claim 14, wherein said tightening device is mounted in correspondence to said connection element.

16. A shower spray device having at least one water distribution chamber in fluid communication with at least one water inlet and with a plurality of water outlet nozzles, wherein:

at least the side wall of said distribution chamber consists wholly or partly of a sealing element such that at least a portion of the sealing element remains exposed external to the distribution chamber even after assembly of the shower spray device, wherein each of said nozzles comprises at one end a perimeter flange designed to be housed in a corresponding seat obtained inside a plate; and wherein a fixing device is provided to retain in position each of said nozzles by blocking said perimeter flange in the respective housing seat.

17. A shower spray device having at least one water distribution chamber in fluid communication with at least one water inlet and with a plurality of water outlet nozzles, said chamber including at least one lower plate housing said outlet nozzles and at least one upper plate in which said inlet is provided, wherein at least a side wall of said distribution chamber consists wholly or partly of a sealing element interposed between said plates, and wherein said sealing element is an elastic sealing element forming at least part of a sidewall of the spray device;

wherein at least one of said plates comprises at least one groove for housing said sealing element;

wherein the upper lower plates are flat and have substantially similar shapes; and wherein at least an outer circumferential part of the elastic sealing element is exposed external to the distribution chamber.

18. A device as claimed in claim 17, wherein the externally exposed outer circumferential part of the elastic sealing element forms at least a part of the side wall of the said distribution chamber.

* * * * *